United States Patent [19]

Taylor

[11] Patent Number: 4,532,752

[45] Date of Patent: Aug. 6, 1985

[54] PRODUCT INDEXING DEVICE

[75] Inventor: Monroe F. Taylor, Greenville, S.C.

[73] Assignee: W. R. Grace & Co., Cryovac Div., Duncan, S.C.

[21] Appl. No.: 536,412

[22] Filed: Sep. 27, 1983

[51] Int. Cl.[3] ..... B65B 9/10; B65B 35/12

[52] U.S. Cl. ..... 53/451; 53/469; 53/551; 53/244

[58] Field of Search ..... 53/451, 551, 469, 552, 53/260, 262, 241, 244, 554

[56] References Cited

U.S. PATENT DOCUMENTS

| | | | |
|---|---|---|---|
| 2,113,636 | 4/1938 | Vogt | 53/551 X |
| 2,969,628 | 1/1961 | Irmscher | 53/551 X |
| 3,262,244 | 7/1966 | Cutler et al. | 53/551 |
| 3,587,958 | 6/1971 | Taylor . | |
| 3,660,205 | 5/1972 | Taylor . | |
| 3,664,088 | 5/1972 | Sherman | 53/551 X |
| 3,675,767 | 7/1972 | Taylor . | |
| 4,118,913 | 10/1978 | Putnam . | |
| 4,144,693 | 3/1979 | Ogata . | |
| 4,274,244 | 6/1981 | Gilbert . | |
| 4,277,302 | 7/1981 | Reid . | |
| 4,288,965 | 9/1981 | James . | |
| 4,291,520 | 9/1981 | Prince . | |
| 4,322,929 | 4/1982 | Neumann . | |

FOREIGN PATENT DOCUMENTS

| | | | |
|---|---|---|---|
| 910181 | 9/1972 | Canada . | |
| 1268077 | 3/1972 | United Kingdom | 53/551 |

*Primary Examiner*—Horace M. Culver

*Attorney, Agent, or Firm*—John J. Toney; William D. Lee, Jr.; Mark B. Quatt

[57] ABSTRACT

The present invention is directed to a new and improved vertical form, fill and seal apparatus which is adapted to individually package relatively large and heavy articles such as, for example, grapefruits, melons, oranges and the like. The apparatus comprises a tube forming mandrel having an upper article entrance orifice, an interior and a lower article discharge orifice. The interior of the mandrel is adapted to contain a group of articles in substantially vertically successive alignment. The mandrel is adapted to progressively form a sheet of flexible plastic film into a vertically depending upwardly open tube having overlapping longitudinal edges which are sealed together. Upon formation of the tube the discharge orifice communicatively connects the interior of the mandrel to the interior of the tube. The form, fill and seal apparatus also comprises article indexing means adapted to selectively retainingly engage and release the lowermost article contained within said mandrel. Furthermore, the apparatus comprises an upper pair and a lower pair of vertically spaced apart horizontal heat seal means wherein the upper surface of the upper heat seal means is located a distance below the discharge orifice of the mandrel with that distance being less than twice the vertical thickness of an article to be packaged. Means for advancing the tube over the mandrel and means for severing the tube to form an individually packaged article are also provided. The invention also comprises a method for individually packaging articles.

11 Claims, 6 Drawing Figures

FIG. I
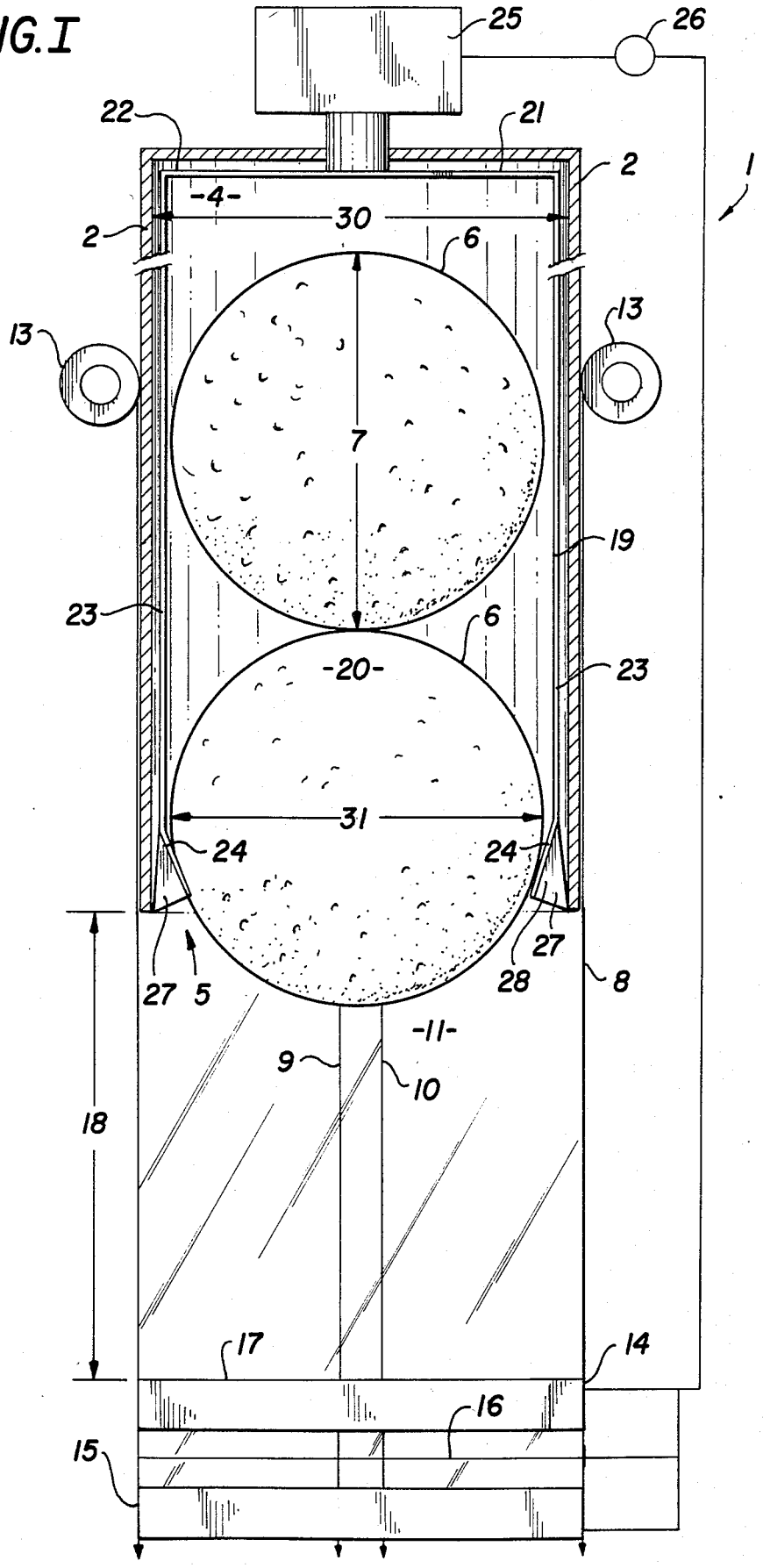

FIG. II
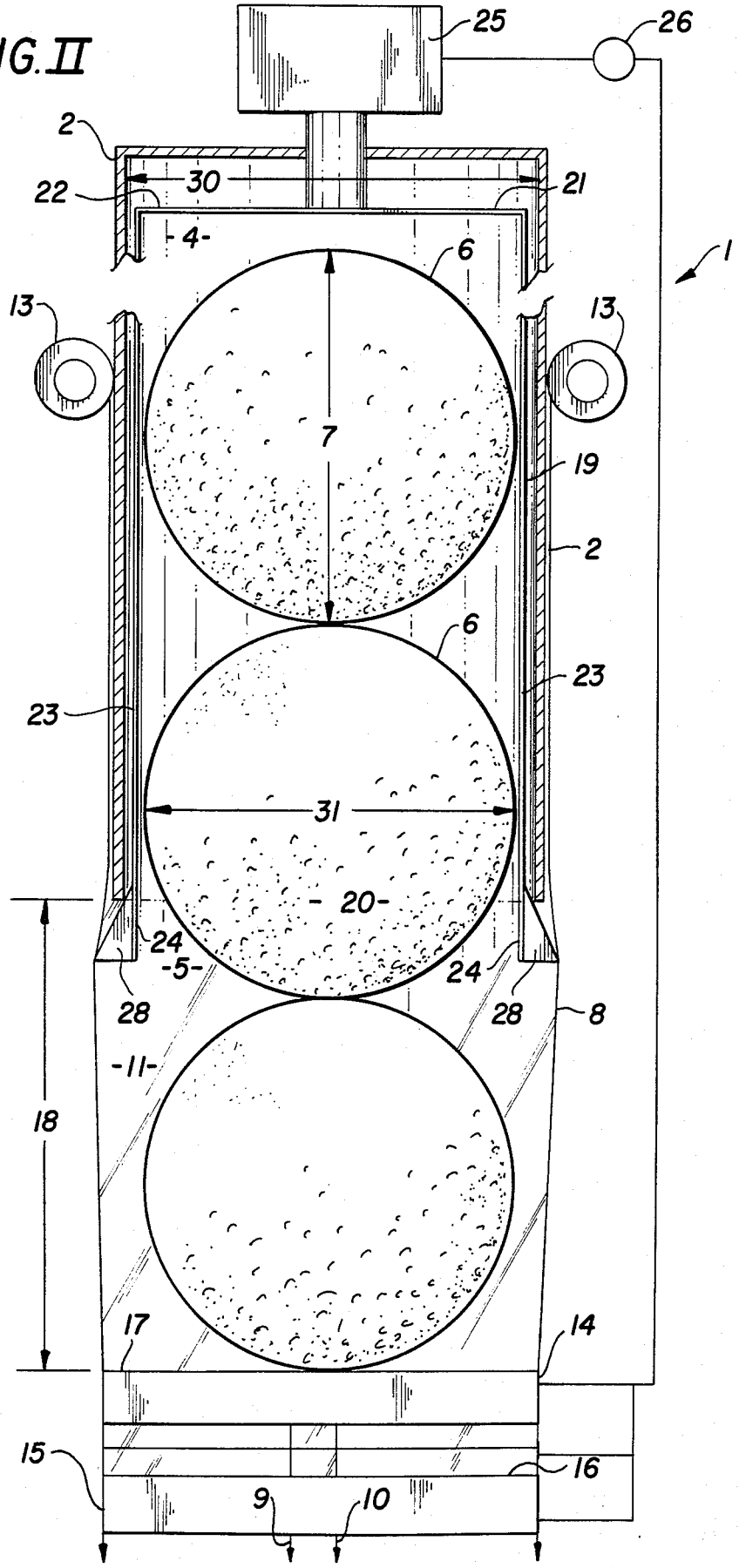

FIG. III
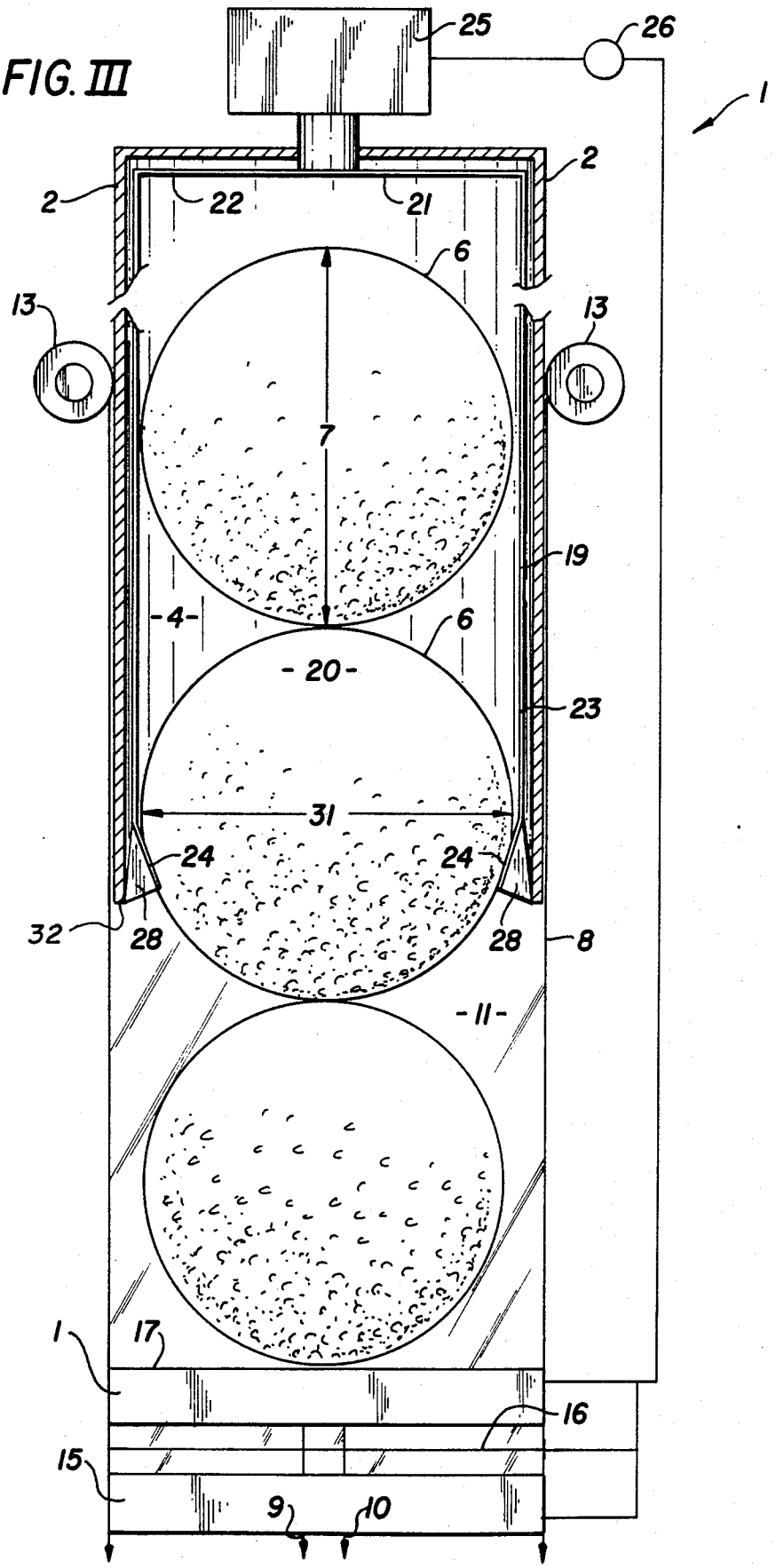

FIG. IV
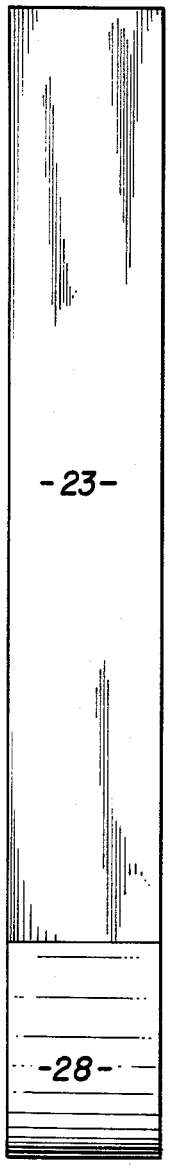
FIG. V
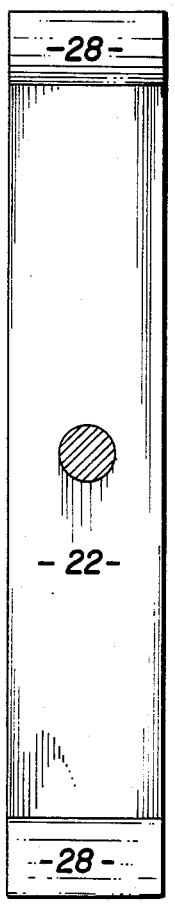
FIG. VI
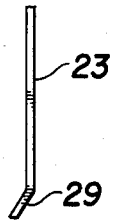

PRODUCT INDEXING DEVICE

FIELD OF THE INVENTION

The field of the present invention encompasses vertical form, fill and seal apparatus for packaging articles. In particular, the field of the present invention is directed to a vertical form, fill and seal apparatus which is adapted to individually package relatively large and heavy articles such as, for example, grapefruits, melons and oranges. Even more particularly, the field of the present invention is directed to a vertical form, fill and seal apparatus for individually packaging relatively heavy articles, as identified above, whereby the packaging or process of loading the articles into the package does not result in rupture of any of the transverse heat seals which form the package by closing the tube.

BACKGROUND OF THE INVENTION

The present invention relates to machines for forming, filling and sealing packages which are made from an elongated thin flat sheet of flexible packaging material. In general, the sheet of flexible packaging material is formed by the apparatus into a vertically depending, upwardly open tube having overlapping longitudinal edges. Thereafter, the overlapping edges are longitudinally sealed together by means well known to those in the art and the end of the tube is sealed together by a pair of transverse heat seals which are vertically spaces apart. At this point the tube is filled from above with a measured quantity of product. A second heat sealing operation, which is performed after the filled tube has been downwardly advanced, completes enclosure of the product. Simultaneously with or shortly after the transverse heat sealing step the tube is completely transversely severed by known cutting means in the space between the vertically spaced apart pair of transverse heat seals. Thereafter the tube is downwardly advanced and the cycle is successively repeated so as to form a multiplicity of individually packaged products.

Many means for advancing the vertically depending, upwardly open tube downwardly over the mandrel are conventional in the art. For example, as stated above, it has been conventional practice to employ heat sealing means for closing (e.g. sealing) the tube by forming a pair of vertically spaced apart transverse heat seals. In one conventional embodiment the sealing bars are moveable in both the horizontal and vertical planes. That is, the sealing bars are intermittently moved horizontally inwardly to engage and compress the tube and form a pair of vertically spaced apart transverse heat seals and are then moved vertically downwardly to feed or draw the packaging material over and past the tube forming mandrel. The transverse heat sealing of the tube occurs during this operation. Thereafter, the sealing bars move horizontally outward to release the tube and return vertically to their starting position.

A further conventional practice in advancing or feeding the packaging material over the mandrel involves the use of a vacuum belt mechanism. In this apparatus a pair of perforate endless belts are disposed respectively on opposite sides of the tube to engage and feed the tube downwardly as a result of a reduced pressure or vacuum condition at the openings in the belt. The tube closing or transverse heat sealing means in this arrangement may be stationary vertically but reciprocally moveable horizontally to intermittently engage and transversely heat seal the tube between feed and product drop or fill operations.

Yet another conventional practice for advancing or feeding the packaging material over the tube former or mandrel involves the use of pinch rollers rather than a belt mechanism. In this configuration two rollers are disposed respectively on opposite sides of the tube with the rollers engaging and feeding the tube downwardly over the mandrel as a result of the fact that the tube is pinchingly engaged between the rollers and the outer surface of the mandrel In all of the foregoing arrangements a relatively long "product drop" is encountered. This product drop is encountered as a result of the fact that the articles to be packaged must be introduced into the interior of the forming mandrel near the top thereof. This arrangement, of course, is necessary since the sheet of flexible packaging material is completely formed into a vertically depending tube shortly below the upper surface of the forming mandrel and access into the interior thereof cannot be gained below this point without destruction of the tubular configuration. Accordingly, the distance which the articles to be packaged must fall upon entrance into the interior of the tube forming mandrel and discharge therefrom is substantial. Additionally, with the vertically moveable transverse heat sealing arrangement the necessary vertical travel of the sealing bars results in a substantial further vertical distance through which an aricle must fall in the filling operation. Furthermore, it should be noted that in this configuration the portion of the formed tube immediately above the tube closing transverse sealing bars is in tension and drawn into a relative sharp or tight "V" configuration during the downward movement of the sealing bars. This configuration is not conducive to a good filling operation nor is the resulting stress at the sealing bars conducive to good sealing.

In the vacuum belt or pinch roller arrangement, the belts or rollers and sealing bar movements can be coordinated to provide for a relaxed condition of the tube above the sealing bars and a relatively shallow or a loose "V" configuration with a slight bulge or ballooning effect can be arrived at. Such a configuration is more conducive to a good filling operation. Transverse heat sealing may also efficiently be accomplished in the absence of stress. The operative run distance of the vacuum belts in that configuration, however, extend through a substantial vertical distance and a relative long product drop distance is, once again, encountered.

While a relatively long "product drop" may not be totally undesirable or unacceptable with articles which are of fairly light weight, it is completely unacceptable when attempting to package articles which are relatively heavy. In particular, a major problem which has developed in attempting to package relatively heavy articles such as, for example, grapefruits, melons, oranges and the like is that the articles, when introduced into the interior of the forming mandrel fall, under the influence of gravity, and impact the preformed transverse heat seals which are utilized to close the tube such that the transverse heat seals are ruptured. Of course, such a situation is wholly unacceptable. This problem exists even when those of skill in the art have attempted to individually package heavy articles.

Accordingly, those of skill in the art have undertaken a quest to provide a vertical form, fill and seal apparatus which will individually package relatively heavy articles without rupturing the transverse heat seals which close the tube as has been present in the past attempts to package such heavy articles. The present inventive apparatus and method provide a satisfactory and cost efficient solution to this outstanding problem.

OBJECTS OF THE PRESENT INVENTION

Accordingly, it is a general object of the present invention to overcome and thus obviate the problems encountered by those of skill in the art in attempting to utilize a vertical form, fill and seal machine to individually package relatively heavy articles such as grapefruits, melons, oranges and the like.

It is another object of the present invention to provide a vertical form, fill and seal packaging apparatus which accomplishes the individual packaging of relatively heavy articles without rupturing the transverse tube closing end seals.

Yet a further object of the present invention is to provide a vertical form, fill and seal packaging machine which may be utilized to individually package relatively heavy articles such as grapefruits, melons, oranges and the like.

A still further object of the present invention is to provide a vertical form, fill and seal packaging process whereby relatively heavy articles such as grapefruits, melons, oranges and the like may be individually packaged.

One further object of the present invention is to provide a vertical form, fill and seal packaging process whereby relatively heavy articles such as grapefruits, melons, oranges and the like may be individually packaged without rupturing the transverse tube closing end seals.

An even further object of the present invention is to provide a vertical form, fill, and seal apparatus and process which allows the article to be packaged to be indexed into the interior of the tube and into a position to be packaged prior to formation of the transverse heat seals.

Still further objects and the broad scope of applicability of the present invention will become apparent to those of ordinary skill in the art from the details given hereinafter. However, it should be understood that the detailed description of the presently preferred embodiments of the present invention is given by way of illustration only since various changes and modifications well within the spirit and scope of the invention will become apparent to those of ordinary skill in the art in view of this detailed description.

SUMMARY OF THE PRESENT INVENTION

It has now been found that the above objects can be obtained through utilization of a vertical form, fill and seal apparatus comprising mandrel means having an upper article entrance orifice, an interior adapted to contain a group of articles in substantially vertically successive alignment, and a lower article discharge orifice with a product indexing means being located in the interior of the mandrel. The mandrel means is adapted to receive a sheet of flexible packaging material and progressively form the sheet into a vertically depending and upwardly open tube having overlapping longitudinal edges whereby the lower discharge orifice communicatively connects the interior of the mandrel with the interior of the tube. The apparatus also comprises longitudinal sealing means adapted to longitudinally seal the overlapping edges together and tube advance means adapted to downwardly advance the formed tube over the mandrel. As stated above, the apparatus includes article indexing means adapted to selectively retainingly engage and release the lowermost article contained within the interior of the mandrel. The apparatus is also provided with upper and lower heat sealing means adapted to initially close the tube below the article discharge orifice and thereafter form two vertically spaced apart transverse heat seals across the tube. Another feature of the apparatus is the provision of cutting means adapted to sever the tube in the space between the vertically spaced apart transverse heat seals. An important feature of the present invention is the location of the upper heat sealing means whereby the top surface of the upper heat sealing means is located a distance below the discharge orifice of said mandrel with said distance being less than twice the vertical thickness of one of the articles to be packaged. The vertical thickness may, preferably, be an average thickness. The apparatus, also includes means for synchronizing the vertical reciprocation of the article indexing means with the horizontal reciprocation (e.g. opening and closing) of the pair of vertically spaced apart transverse heat sealing means. In one preferred embodiment of the present invention the article indexing means comprises an inverted "U"-shaped strip of flexible material preferably formed from a resiliant, flexible metal such as stainless steel. The inverted strip is located within the interior of said mandrel and may be selectively reciprocally raised and lowered by pneumatic or other appropriate means. The inverted U-shaped strip is provided, at the lower extreme of its depending legs, with means for inwardly deflecting the lower leg portions into retaining and engaging contact with the lowermost article contained within the interior of the mandrel. Particularly preferred deflection means include a wedge-shaped element attached to the outer surface of the legs of the inverted U-shaped strip at the lower portion thereof or, alternatively, providing each leg of the inverted U-shaped strip with an outward bend near the lower portion thereof.

The present invention is also directed to a vertical form, fill and seal process for packaging articles including the steps of:

providing a mandrel having an upper article entrance orifice, an interior adapted to contain a group of articles in substantially vertically successive alignment, a lower article discharge orifice with product indexing means being located within said mandrel and adapted to selectively retainingly engage and release the lowermost article contained within said mandrel;

providing a group of articles into the interior of the mandrel by passing the articles through the article entrance orifice whereby the articles are substantially vertically successively aligned, the lowermost article contained within the mandrel is retainingly engaged and downward advancement of the group of articles substantially prohibited;

advancing a flexible sheet of packaging material about and past the mandrel to progressively form a vertically depending, upwardly open tube having overlapping longitudinal edges whereby the lower discharge orifice communicatively connects the interior of the mandrel to the interior of the tube;

longitudinally sealing the overlapping edges together;

utilizing upper and lower heat seal means to close the tube below the discharge orifice wherein the top surface of the upper heat seal means is located a distance below the discharge orifice with the distance being less than twice the vertical thickness of one of said articles;

releasing the lowermost article contained in the mandrel whereby downward advancement of the group of articles is allowed and the lowermost article exits from the interior of the mandrel through the discharge orifice, is discharged into the interior of the tube and downwardly advances into supporting contact with the upper surface of the upper heat seal means or its equivalent;

forming two vertically spaced apart transverse heat seals across the tube and transversely severing the tube in the space between the two vertically spaced apart heat seals;

retainingly engaging the next vertically successive article to be packaged—this article is now the lowermost article contained within the interior of the mandrel—whereby downward advancement of said group of articles is substantially prohibited; and whereby the articles are individually packaged and the transverse heat seals are not ruptured.

In one preferred process embodiment the two vertically spaced apart transverse heat seals are formed prior to release of the lowermost article. In an even more preferred embodiment the two vertically spared apart transverse heat seals are not formed until after the lowermost article has been released and is in supporting contact with the upper surface of the upper heat seal means.

BRIEF DESCRIPTION OF THE DRAWINGS

FIG. I is a schematic cross-sectional view of a tube forming mandrel with a product indexing device in accordance with the present invention located within the interior thereof. Other ancillary components are also schematically represented. The vertical form, fill and seal machine is not illustrated as a whole so that the present improvement can be discussed with clarity. FIG. I represents the position of an initial or start-up position of the indexing device.

FIG. II is a schematic cross-sectional view of the product indexing device of the present invention illustrating a second position thereof.

FIG. III is a schematic cross-sectional view of the product indexing device of the present invention illustrating a third position thereof.

FIG. IV is a side plan view of the inverted "U"-shaped portion of the product indexing device of the present invention.

FIG. V is a top plan view of the inverted "U"-shaped portion of the product indexing device of the present invention.

FIG. VI is an edge plan view of a left leg of a preferred embodiment of the inverted "U"-shaped portion of the product indexing device of the present invention.

DESCRIPTION OF THE PREFERRED EMBODIMENTS

The present invention is directed to an improvement in and to presently existing and well known vertical form, fill and seal machines. To improve clarity and avoid confusion reference to this well-known type of machinery is accomplished by incorporation by reference of exemplary non-limiting examples of this type of machine. In particular, this type of machine is illustrated in U.S. Pat. No. 4,322,929 to Neumann; U.S. Pat. No. 4,291,520 to Prince; U.S. Pat. No. 4,288,965 to James; U.S. Pat. No. 4,277,302 to Reid; U.S. Pat. No. 4,274,244 to Gilbert; U.S. Pat. No. 4,144,693 to Ogata and U.S. Pat. No. 4,118,913 to Putnam. All of these patents are hereby incorporated by reference. These patents generally disclose that it has heretofore been well known to provide a vertical form, fill and seal machine for packaging articles wherein the machine comprises (1) mandrel means having an upper article entrance orifice, an interior and a lower article discharge orifice with the mandrel means being adapted to receive a sheet of flexible plastic packaging material and progressively form the sheet into a vertically depending and upwardly open tube having overlapping longitudinal edges whereby the lower discharge orifice communicatively connects the interior of the mandrel with the interior of the tube; (2) longitudinal sealing means adapted to longitudinally seal the overlapping edges of the sheet together; (3) tube advance means adapted to downwardly advance the tube; (4) upper and lower heat sealing means adapted to sealingly close the tube below the article discharge orifice by forming two vertically spaced apart transverse heat seals across the tube; and (5) cutting means adapted to sever the tube in the space between said transverse heat seals. Furthermore, it will become apparent after review of the below-detailed discussion that the improved form, fill and seal machine of the present invention further comprises, in combination, (1) mandrel means having an interior adpated to contain a group of articles in substantially vertically successive alignment; (2) article indexing means adapted to selectively retainingly engage and release a lowermost article contained within the mandrel; and (3) upper heat sealing means having a top surface located a distance below the article discharge orifice wherein that distance is less that twice the vertical thickness of one of the articles to be individually packaged.

Turning now to the figures wherein like reference numerals represent like structure and, in particular to FIG. I, it can be seen that a tube former means for forming a sheet of a flexible plastic material into a tube is generally designated at 1. Forming means 1 is schematically illustrated in cross section to better illustrate and teach the invention. Tube forming means 1 comprises a mandrel means 2 which, in the presently preferred embodiment, is in the form of a hollow tubular cylinder having an upper side article entrance orifice 3 (not shown), an interior 4 and a lower article discharge orifice 5. As can be seen in the figures, the interior 4 of mandrel 2 has been adapted to contain a group of articles 6 in substantially vertically successive alignment. Articles 6 which are herein schematically represented in spherical shape have a vertical thickness 7. Of course, the shape of the articles and the thickness thereof will vary somewhat from article to article. This is especially true when the articles are produce and the like.

Mandrel means 2 is adapted to receive a sheet (not shown) of flexible plastic packaging material and progressively form said sheet into a vertically depending and upwardly open tube 8 having overlapping longitudinal edges 9 and 10. Upon formation of tube 8 by mandrel means 2, as a result of the passage of the sheet of flexible packaging material about mandrel means 2, the interior 4 of mandrel 2 is communicatively connected with the interior 11 of tube 8 by way of lower article discharge orifice 5. Furthermore, during passage of tube 8 over mandrel 2 and after longitudinal edges 9 and 10 have been overlapped, edges 9 and 10 are longitudinally sealed together by longitudinal sealing means 12, well known to those in the art, not shown for purpose of clarity. If longitudinal sealing means 12 were included in the figures, means 12 would be located directly on the opposite side of mandrel 2 since that is the side whereupon edges 9 and 10 are overlapped. Tube advance means in the form of roller means are provided to advance tube 8 over mandrel 2. Of course, as stated above, many other means for advancing tube 8 over and past mandrel 2 are well known in the art. Roller means 13 are illustrative of a presently preferred embodiment. Means 13 act as pressure nip rolls to advance tube 8 over mandrel 2. Preferably, means 13 comprises an outer surface of a high friction material such as rubber or another material which assures complete and adequate gripping of tube 8.

It should be noted that in the figures the roll stock sheet of flexible packaging material is not shown. The tube forming sheet material is only illustrated after the point where it has been formed into tube 8 and is being passed over mandrel 2 by rollers 13.

FIG. I also illustrates that the apparatus comprises upper 14 and lower 15 transverse heat sealing means adapted to sealingly close the tube 8 below the article discharge orifice 5 by forming two vertically spaced apart transverse heat seals across tube 8. Heat sealing means of this type are well known to those of skill in the art and may comprise two vertically spaced apart pairs of transverse heat seal bars. In a preferred embodiment heat seal means 14 and 15 comprise electrical impulse heat sealing means. The apparatus also includes cutting means 16 which is adapted to sever the tube in the space between the two vertically spaced apart transverse heat seals.

An important feature of the present invention is that upper heat seal means 14 is positioned so that the upper surface 17 of upper heat sealing means 14 is located a specific distance 18 below said discharge orifice 5 at least upon initial closing of the tube by upper heat seal means 14. In particular, distance 18 must be less than twice the vertical thickness 7 of the articles 6 which are to be individually packaged. The reason for this feature will be discussed in more detail below.

The improved apparatus of the present invention also comprises article indexing means generally indicated at 19. Article indexing means 19 is adapted to selectively retainingly engage and release the lowermost article 20 contained within the interior 4 of the mandrel. Article indexing means 19, preferably, comprises an inverted U-shaped strip 21 of flexible material, preferably stainless steel. Inverted U-shaped strip 21 comprises cross connecting portion 22 and legs 23. Legs 23 are provided, at their lowermost portion with an article retaining and engaging surface 24. Article indexing means 19 should be arranged within the interior 4 of mandrel 12 in such a manner that upper side article entrance orifice is not crossed or obstructed by any part of means 19 during its reciprocation within interior 4. This arrangement is necessary to allow articles 6 to enter interior 4 freely and without interruption.

Additionally, means for vertically reciprocating article indexing means 19 within the interior 4 of mandrel 2 is provided as at 25. Reciprocation means 25 is preferably pneumatic. However, any other means well known to those of skill in the art such as mechanical, electrical, hydraulic, etc. are acceptable. Reciprocation means 25 is joined to the top cross connecting portion 22 of the inverted U-shaped strip 21 and thus may selectively vertically reciprocate means 19 within interior 4. Timing or synchronization means 26 is provided to synchronize the vertical reciprocation of article indexing means 19 with the opening and closing of the upper and lower heat seal means 14 and 15 and also with the action of tube feed means such as rollers 13. Synchronization or timing means 26 are well known to those of skill in the art.

Lastly, the article retaining and engaging surface 24 of legs 23 is provided with deflection means 27 for selectively inwardly deflecting surface 24 whereby the lowermost article 20 contained within the interior 4 of mandrel 2 may be selectively retainingly engaged or released. Deflection means 27 may take the form of a wedge-shaped element 28 attached to the outer surface of the lower or foot portion of legs 23. Such a configuration is illustrated in FIGS. I, II and III. Alternatively, deflection means 27 may comprise an outward bend 29 near the lower or foot portion of leg 23. Such a configuration is illustrated in FIG. VI.

In operation the improved vertical form, fill and seal machine of the present invention performs as follows:

Referring to FIG. I it is seen that, initially, article indexing means 19 is vertically positioned within the interior 4 of mandrel 2 whereby deflection means 27 inwardly deflects retaining engaging surfaces 24 of legs 23. This inward deflection effectuates a partial occlusion or narrowing of lower article discharge orifice 5 and thereby effectively blocks or prohibits the downward movement of the group of articles 6 to be packaged upon their provision into the interior 4 of mandrel 2 by way of upper article entrance orifice 3 (not shown). Downward movement of the group is prohibited as a result of surface 24 of the indexing means 19 retainingly engaging the lowermost article 20. Accordingly the group of articles is substantially vertically successively retained. Of course, it is necessary for the interior diameter 30 of mandrel 2 not to be significantly larger than the horizontal thickness 31 of the articles 6 to be packaged. In particular, the interior diameter 30 of mandrel 2 should be dimensioned so that the articles 6, as stated above, will be substantially vertically successively aligned as illustrated in FIGS. I, II and III. Thus, one preferred embodiment of the present invention is directed to a mandrel means 2 having a selectively variable interior diameter whereby the diameter 30 of interior 4 of mandrel 2 may be readily adapted to substantially vertically successively align various sized articles. One means for accomplishing this objective is to have several different mandrels having appropriate different interior diameters. Alternatively the mandrel 2 may be manufactured from a flexible sheet of material and then rolled into a tube form having overlapping edges. The interior diameter of the mandrel may then be varied by changing the degree of overlap.

FIG. I also illustrates that a sheet of flexible plastic material has been formed into a vertically depending and upwardly open tube 8 with the tube 8 being downwardly fed over mandrel 2 by the action of tube advance means 13. The edges 9 and 10 of the sheet of flexible plastic material have been overlapped by passage of the sheet over and about mandrel 2 and thereafter longitudinally sealed together by sealing means 12 (not shown) well known in the art. Accordingly, article discharge orifice 5 communicatively connects the interior 4 of mandrel 2 with the interior 11 of tube 8.

An upper pair 14 and lower pair 15 of vertically spaced apart heat seal bar means which provide vertically spaced apart transverse heat seals on tube 8 are located below article discharge orifice 5. Tube 8 is positioned so that it passes between each pair of heat seal bar means. The heat seal means are adapted to initially close the tube 8 and thereafter form two vertically spaced apart transverse heat seals. Cutting means 16 is provided and located between the two vertically spaced apart pairs of transverse heat seals means. Cutting means 16 is adapted to sever the tube 8 in the space between the two vertically spaced apart transverse heat seals.

Synchronization or timing means 26 is provided to synchronize the vertically reciprocal raising and lowering cycle of article indexing means 19 with the horizontally reciprocal opening and closing cycle of heat sealing means 14 and 15. In particular, synchronization means 26 is preferably adapted so that article indexing means 19 reaches its vertically uppermost position at or about the point in time when the pairs of horizontal heat seal means are completely open. This configuration is best illustrated in FIG. I which illustrates both the initial configuration present upon loading the apparatus and the configuration which is thereafter duplicated during each packaging cycle.

Turning to FIG. II it can be seen that synchronization means is adapted to provide reciprocation means 25 with a signal indicating that indexing means 19 should be lowered whereby indexing means 19 preferably reaches its lowermost point substantially at the point in time when heat seal means 14 and 15 are initially closed. FIG. II illustrates that when article indexing means 19 is lowered deflection means 27 exits the interior 4 of mandrel 2 and protrudes downwardly below article discharge orifice 5. Accordingly, leg means 23 are allowed to assume their natural non-inwardly deflected position and move radially outward to an extent where retaining and engaging surface 24 no longer substantially occludes article discharge orifice 5. Thus, it can be seen that this action effectively disengages or releases the lowermost article 20 and allows the further downward advancement of the group of articles 6 as a result of gravitational forces.

In FIGS. I, II and III the upper surface 17 of upper heat seal means 14 is located a distance 18 below discharge orifice 5 which is only slightly greater than the diameter of the substantially spherical articles which are to be packaged. This configuration allows the lowermost article 20 contained within the interior 4 of the mandrel 2 to exit the interior 4 of mandrel 2 by way of article discharge orifice 5 and enter the interior 11 of tube 8. Furthermore, article 20 falls, under the influence of gravity into supporting contact with the upper surface 17 of upper heat seal means 14. Upper surface 17 of upper heat seal means 14 is available to support the released lowermost article 20 since, at this point in the cycle, the upper and lower heat seal means are closed and located below discharge orifice 5. The pair of vertically spaced apart transverse heat seals may be formed substantially simultaneously with the closing of the transverse heat sealing means or the signal from synchronization means 26 directing the impulse heat sealing to be effected may be slightly delayed in time to the point where the article discharged from the interior 4 has come to substantial rest on surface 17. This slight delay allows the transverse heat seals to be formed after the group of articles have dropped. Delays on the order of 1–3 seconds are appropriate. Thus, the transverse heat seals are not subjected to stress from "product drop" and are not ruptured thereby. Furthermore, cutting means 16 is simultaneously or shortly thereafter activated thereby severing the tube 8 in the space between the two vertically spaced apart horizontal heat seals.

The next step in the process is best illustrated by FIG. III wherein synchronization means 26 has signaled means 25 to raise article indexing means 19 and also has signaled heat seal bar means 14 and 15 to begin opening. Upon raising of indexing means 19 deflection means 27 encounters the rim 32 of article discharge orifice 5 and thereby deflects the article retaining and engaging surface 24 of legs 23 into retaining engagement with the next vertically successive aligned article 6 which is now the lowermost article 20 contained within the interior 4 of mandrel 2. Of course, the upper surface 17 of upper heat seal means 14 must be appropriately positioned so that only one article 6 will exit the interior 4 of mandrel 2 during a given cycle. The positioning of the upper surface 17 will vary depending upon the size and shape of the articles 6 to be individually packaged. In the case of substantially spherical articles, as illustrated, the distance 18 should be greater than the radius of an article but less than three times the radius of an article. This correlation is necessary because if the distance was less than the radius of a given spherical article (that is, less than one-half the vertical thickness of an article) the engaging surface 24 of indexing means 19 would repeatedly engage and retain the same lowermost article 20 and no downward article advancement would occur during the cycle. In the other extreme, if the distance 18 was greater than three times the radius of a given spherical article (that is greater than one and one-half times the vertical thickness of the article) more than one article would be discharged per cycle. Accordingly, individual packaging of spherical articles would not be accomplished. As stated above the maximum and minimum distances 18 will vary depending upon the size and shape of the articles to be packaged. However, at least one generalization does hold true for any shape and size of articles. This is that the distance 18 which upper surface 17 of upper heat seal means 14 is below rim 32 of article discharge orifice 5 must be less than twice or two times the vertical thickness of the articles to be packaged. If distance 18 is greater than two times the vertical thickness of the articles to be packaged, two or more articles, regardless of their shape and size, will exit the interior 4 of mandrel 2 and individual packaging of an article will not be accomplished. Of course, the nature of the articles may be that they are not all identical. Such is the case when packaging grapefruits etc. In this case the distance 18 should be adjusted within the above discussed ranges, to effectuate proper packaging. Thus, one preferred embodiment includes means for vertically adjusting the position of the heat seal means whereby distance 18 may be readily varied according to the product being packaged. An effective method of assuring that most articles will be properly packaged is using the average vertical thickness of a group of articles, for example thirty (30), in arriving at the vertical thickness of "an article".

After the next vertically successive now lowermost article 20 has been engaged and retained, as illustrated in FIG. III, synchronizing means 26 signals heat sealing means 14 and 15 to completely open and also signals tube advance means 13 to advance an amount of tube 8 sufficient to allow the article to pass below lower heat seal means 15. Such action allows the article which was retainingly supported by the upper surface 17 of upper heat seal means 14 to pass down between the two pairs of heat seal bar 14, 15. Upon repetition of the above described packaging cycle it will be seen that lower heat seal means 15 forms the upper seal of a package for the article which has just passed below the lower heat seal means 15. Upon severing of the tube by means 16 in the space between the vertically spaced apart transverse heat seal means 14, 15 it can be seen that each article will be individually packaged.

A prime advantage of the present process is that when large, relatively heavy articles are packaged they are essentially lowered and dropped only a small distance and are supportedly retained by the upper surface 17 of the upper heat seal means 14 upon completion of the product drop. This action virtually eliminates the problems associated with the rupturing of the bottom heat seal of a package formed by the prior art apparatus and processes when they were utilized to package heavy articles. An additional side advantage of the present process is that bruising and other damage to the product is reduced since the product is not dropped a great distance.

In summary, it can be seen that the present vertical form, fill and seal process for individually packaging articles includes the steps of:

providing a mandrel having an upper article entrance orifice, an interior adapted to contain a group of articles in substantially vertically successive alignment, a lower article discharge orifice and means adapted to selectively retainingly engage and release a lowermost article contained within the mandrel;

providing a group of articles into the interior of the mandrel by passing the articles through the article entrance orifice whereby said articles are substantially vertically successively aligned, the lowermost article contained within said mandrel is retainingly engaged and downward advancement of the group of articles is substantially prohibited;

advancing a flexible sheet of packaging material about the mandrel to progressively form a vertically depending, upwardly open tube having overlapping longitudinal edges whereby the lower discharge orifice communicatively connects the interior of the mandrel to the interior of the tube;

longitudinally sealing the overlapping edges of the tube together;

utilizing upper and lower heat seal means to close the tube below the article discharge orifice wherein the top surface of the upper heat seal means is located a distance below the article discharge orifice and that distance is less than twice the vertical thickness of the articles to be packaged;

releasing the lowermost article contained in said mandrel whereby downward advancement of the group of articles is allowed and the lowermost article exits the interior of the mandrel through the discharge orifice, is discharged into the interior of the tube and downwardly advances into supporting contact with the upper surface of the upper heat seal means;

forming two vertically spaced apart transverse heat seals across the tube and transversely severing the tube in the space between the two vertically spaced apart heat seals;

retainingly engaging the next vertically successive now lowermost article contained in said mandrel whereby downward advancement of said group is substantially prohibitied; and whereby said articles are individually packaged and said transverse heat seals are not ruptured.

As stated above, preferably, the average vertical thickness of a large group of articles is utilized in determining the vertical thickness of "an article" and thereby distance 18. Furthermore, distance 18 as stated above will vary depending upon the size and shape of the articles to be packaged.

One preferred process embodiment comprises the step of forming the transverse heat seals substantially simultaneously with contact of a dropped article to be packaged with the upper surface 17 of upper heat seal means 14. An even more preferred embodiment is to form the transverse heat seal slightly after a dropped article has contacted the upper surface 17 of upper heat seal means 14. This delay is usually on the order of 1 to 3 seconds. To accomplish this action the apparatus may optionally include a sensing device located on upper surface 17 which signals heat seal means 14 and 15 to form, for example, an impulse seal upon contact therewith by an article or at any appropriate time delay thereafter. Such means are well know in the art.

It is to be understood that variations and modifications of the present invention may be made without departing from the scope of the present invention. It is also to be understood that the scope of the invention is not to be interpreted as limited to the specific embodiments disclosed herein, but only in accordance with the appended claims when read in light of the foregoing disclosure.

I claim:

1. In a vertical form, fill, and seal machine for individually packaging relatively heavy articles such as grapefruit and the like, the improvement comprising:

a substantially vertical mandrel means having an upper entrance orifice, an interior, and a lower orifice;

article indexing means comprising an inverted U-shaped flexible strip having a cross connecting portion and two leg portions with each of said leg portions having lower article retaining and engaging portions; and upper transverse heat sealing means having a top surface located a distance below a discharge orifice of said mandrel wherein said distance is less than twice an average vertical thickness of one of said articles.

2. The vertical form, fill and seal machine of claim 1, wherein the article retaining and engaging portions of said legs comprise deflection means which are adapted to selectively inwardly deflect the article retaining and engaging means.

3. The vertical form, fill and seal machine of claim 2, wherein said deflection means comprises a wedge-shaped element.

4. The vertical form, fill and seal machine of claim 2, wherein said deflection means comprises an outwardly bent lower leg portion.

5. The vertical form, fill and seal machine of claim 1, further comprising synchronization means adapted to synchronize the engaging and releasing of said lowermost article by said indexing means with horizontal reciprocation of said upper heat seal means.

6. The vertical form, fill and seal machine of claim 5, further comprising reciprocation means adapted to vertically reciprocate said article indexing device.

7. The vertical form, fill and seal machine of claim 1, wherein said distance is determined by utilizing an average vertical thickness of a group of said articles.

8. A vertical form, fill and seal process for packaging articles comprising the steps of:

using a mandrel comprising an upper article entrance orifice, an interior adapted to contain a group of articles in substantially vertically successive alignment, a lower article discharge orifice and means adapted to selectively retainingly engage and release a next lowermost article contained within said mandrel;

providing a group of articles into the interior of said mandrel by passing said articles through said article entrance orifice whereby said articles are substantially vertically successively aligned, the lowermost article contained within said mandrel is retainingly engaged and downward advancement of said group is substantially prohibited;

advancing a flexible sheet of packaging material about said mandrel to progressively form a vertically depending, upwardly open tube having overlapping longitudinal edges whereby said lower discharge orifice communicatively connects the interior of said mandrel to the interior of said tube;

longitudinally sealing said overlapping edges together;

utilizing upper and lower heat seal means to close said tube below said discharge orifice wherein the top surface of said upper heat seal means is located a distance below said discharge orifice and said distance is less than twice the vertical thickness of one of said articles;

releasing the lowermost article contained in said mandrel whereby downward advancement of said group is allowed and said lowermost article exits the interior of said mandrel through said discharge orifice, is discharged into the interior of said tube and downwardly advances into supporting contact with the upper surface of said upper heat seal means;

forming two vertically spaced apart transverse heat seals across said tube and transversely severing said tube in the space between said two vertically spaced apart heat seals;

retainingly engaging a lowermost article contained in said mandrel whereby downward advancement of said group is substantially prohibited; and whereby said articles are individually packaged and said transverse heat seals are not ruptured.

9. The process of claim 8, wherein said vertically spaced apart transverse heat seals are formed substantially simultaneously upon contact of said upper surface by an article.

10. The process of claim 8, wherein formation of said vertically spaced apart transverse heat seals is delayed until after contact of said upper surface by an article.

11. The process of claim 10, wherein said delay is about 1 to 3 seconds.

* * * * *